United States Patent [19]

Bond et al.

[11] Patent Number: 4,736,547

[45] Date of Patent: Apr. 12, 1988

[54] STEEL ABRADING ELEMENTS FOR MASS FINISHING OF WORKPIECES AND METHODS OF MAKING AND USING SAME

[75] Inventors: Roger A. L. Bond, Farmington; Stephen J. Nigro, Wethersfield, both of Conn.

[73] Assignee: The Abbott Ball Company, West Hartford, Conn.

[21] Appl. No.: 31,691

[22] Filed: Mar. 27, 1987

[51] Int. Cl.[4] ..... B24B 31/02

[52] U.S. Cl. ..... 51/164.5; 51/313; 241/184

[58] Field of Search ..... 51/164.5, 313; 241/184; 125/18, 21

[56] References Cited

U.S. PATENT DOCUMENTS

| | | | |
|---|---|---|---|
| 90,824 | 6/1869 | Dickenson | 51/283 R |
| 591,225 | 10/1897 | Bartlett | 51/164.5 |
| 741,606 | 10/1903 | Zarniko | 241/176 |
| 983,028 | 1/1911 | Davidsen | 241/184 |
| 1,016,272 | 2/1912 | Johnson | 241/184 X |
| 1,133,368 | 3/1915 | DeVilkiss | 51/164.5 |
| 1,154,734 | 9/1915 | Slick | 241/291 |
| 1,218,158 | 3/1917 | Andrews | 51/164.5 |
| 1,262,115 | 4/1918 | Smallwood | 241/184 X |
| 1,366,651 | 1/1921 | Hardinge | 241/179 |
| 1,388,462 | 8/1921 | Hardinge | 241/184 |
| 1,393,334 | 10/1921 | Bachman | 241/184 |
| 1,453,120 | 4/1922 | Beaver | 51/164.5 |
| 1,531,275 | 3/1924 | Culp | 51/316 |
| 1,585,663 | 11/1924 | George | 84/147 |
| 1,682,246 | 3/1926 | Read | 51/164.5 |
| 1,797,981 | 4/1926 | George | 51/164.5 |
| 1,860,393 | 5/1930 | Newhouse | 241/184 |
| 1,864,542 | 5/1930 | Halzapfel | 241/184 |
| 2,003,994 | 6/1935 | D'Avocourt | 125/21 |
| 2,143,732 | 1/1939 | Gernelle | 241/184 |
| 2,431,870 | 11/1944 | Huinerfauth et al. | 51/164.5 |
| 2,876,761 | 3/1959 | Stevens | 125/21 |
| 2,947,124 | 8/1960 | Madigon | 51/316 |
| 2,978,850 | 4/1961 | Gleszer | 51/316 |
| 3,375,615 | 4/1968 | Ricker | 51/316 |
| 3,808,747 | 5/1974 | Kenagy | 51/164.5 |
| 4,634,062 | 1/1987 | Berchem | 241/184 |

FOREIGN PATENT DOCUMENTS

| | | | |
|---|---|---|---|
| 0033562 | 12/1981 | European Pat. Off. | 51/164.5 |
| 482071 | 6/1916 | France | 241/184 |
| 26556 | 1/1922 | France | 241/184 |
| 132985 | 10/1919 | United Kingdom | 241/184 |
| 329131 | 5/1930 | United Kingdom | 241/184 |
| 430471 | 6/1935 | United Kingdom | 241/184 |
| 0997804 | 2/1983 | U.S.S.R. | 241/184 |

OTHER PUBLICATIONS

Die Casting Supplement "Machinery" Mar. 27, 1952, vol. 80, Barrel Finishing by H. K. Barton, pp. 555 to 560.

*Primary Examiner*—Frederick R. Schmidt
*Assistant Examiner*—Shirish Desai

[57] ABSTRACT

An abrading element for mass finishing of workpieces such as vibratory finishing comprises an elongated metallic rod of generally circular or other curvilinear cross section with serrations extending over substantially its entire periphery along its elongated axis. The serrations provide cutting edges along their outer surfaces and recesses therebetween. The metal of the rod is hardened at least in the portion adjacent the surface to provide hardened cutting edges and a wear resistant surface. The abrading elements are conveniently formed by severing rod or wire stock in the desired length and rolling or otherwise forming the desired serrations therein, after which the abrading elements may be hardened.

11 Claims, 1 Drawing Sheet

STEEL ABRADING ELEMENTS FOR MASS FINISHING OF WORKPIECES AND METHODS OF MAKING AND USING SAME

BACKGROUND OF THE INVENTION

Mass finishing of workpieces is widely employed in the processing of the workpieces prior to other manufacturing steps such as electroplating and chemical surface treatment (chromating, anodizing, etc.). The barrel, vibratory, centrifugal, and other like techniques for mass finishing cause a mass of workpieces and the surrounding media to move relative to each other with the media impinging upon the surface of the workpiece, and producing a finishing, polishing, or cutting action, depending upon the nature of the media, the hardness of the workpieces, and the nature of the finishing compounds which may be used in connection therewith. In some instances, only deburring is desired; in other instances, polishing and other controlled degrees of surface finishing are desired.

Among the various types of media used in such mass finishing operations are natural media such as stone, wood, and ground corn cobs; synthetic media such as ceramic-bonded abrasive particles, resin-bonded abrasive particles, and fused aluminum oxide; and metallic media, such as steel and zinc balls, rods, pins, and other elements of various configurations.

As indicated, there may be used in connection with the media finishing, compositions which tend to keep the workpieces and the media clean, and which may have abrasive characteristics to facilitate the surface treatment of the workpieces.

Natural and synthetic media tend to wear away during the finishing process, and generally lose their effectiveness as they are reduced in size and as their contour varies from the optimum contour originally provided. Moreover, the material eroded or broken from the media may interfere with further polishing operations and require a large flow rate of the finishing composition through the media and workpieces to minimize the interference. Metallic media will, when of proper hardness, wear to a significantly lesser extent than the other media, but generally must be used in conjunction with abrasive finishing compounds in order to achieve the desired abrading or polishing action since the surface of the metallic media does not have the abrasive characteristics necessary.

It has been proposed to utilize sintered metal media having a surface configuration which would abrade the surface of the workpieces, but such sintered metal elements are subject to rapid deterioration under the mass finishing conditions, and produce a slurry in the finishing compound which tends to contaminate the workpieces.

It is an object of the present invention to provide novel metallic abrading elements which will effectively abrade the surface of workpieces and exhibit a relatively long useful life.

It is also an object to provide such abrading elements which may be readily fabricated at relatively low cost, and which may be hardened to provide the desired hardness characteristics for the abrading surface.

Another object is to provide a novel method for generating novel rugged and desirable metal abrading elements for mass finishing of workpieces.

A further object is to provide a novel method for mass finishing of workpieces using novel metallic abrading elements configured to provide abrading surfaces.

SUMMARY OF THE INVENTION

It has now been found that the foregoing and related objects may be readily attained by abrading elements for mass finishing operations which comprise an elongated metallic rod of generally curvilinear cross section. The rod has serrations over substantially the entire periphery along its elongated axis, and these serrations provide cutting edges along the outer surfaces thereof and recesses therebetween. At least the surface portion of the metal of the rod is hardened to the desired degree of hardness.

The abrading elements preferably have a generally circular cross section and conveniently have their axial ends skewed relative to an imaginary plane perpendicular to the elongated axis. The serrations may extend generally longitudinally of the rod, or generally helically about its periphery. In one preferred form of the invention, the serrations are disposed in a diamond pattern.

The metal of the rod may be low carbon steel and only the surface portion of the rod need be case hardened. Alternatively, the rod may be fabricated from high carbon or alloy steel, and the rod may be hardened throughout its cross section.

Generally, the rods will be formed from wire stock with a diameter of 0.025–0.5 inch and a length of 0.025–2.5 inches with an L/D ratio of at least 2:1. The hardness of at least the surface portion will be at least 50 on the Rockwell "C" scale.

The abrading elements are conveniently made by cutting a length of metal rod or wire into elongated metallic rods of generally curvilinear cross section. Serrations are formed over substantially the entire periphery of the rods along their elongate axes, and the metal of the rods is thereafter hardened at least adjacent the surface thereof.

Conveniently, the step of forming the serrations comprises the passing of the rods through a thread rolling machine, and the hardening step comprises heat treating at least the surface thereof to provide the desired degree of hardness.

DETAILED DESCRIPTION OF THE ILLUSTRATED EMBODIMENT

Figure 1:
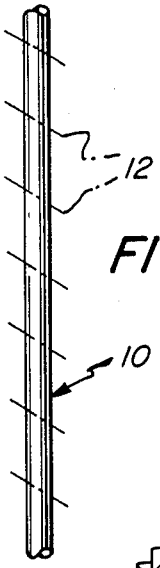
FIG. 1 is a fragmentary view of a length of wire or rod stock with diagonal lines indicating the points and angles at which the rod is to be severed to provide a series of rod elements for the present process.

In FIG. 1, there is illustrated a length of rod or wire stock generally designated by the numeral 10 and having a generally circular cross section. The diagonal lines 12 schematically indicate the points and planes along which the rod 10 will be severed to form relatively short rod elements.

Figure 2:
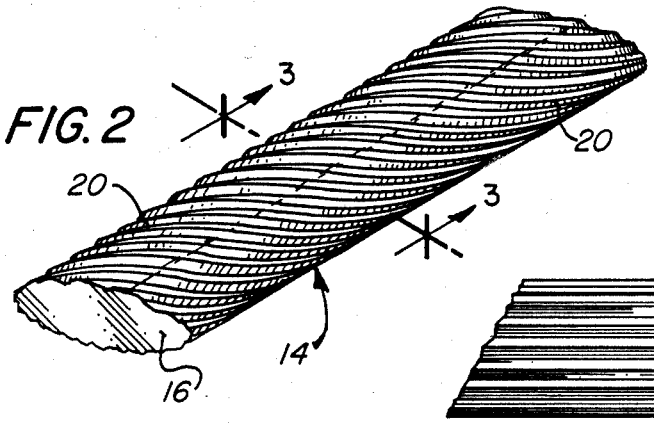
FIG. 2 is a perspective view to an enlarged scale of a severed length of the rod seen in FIG. 1 subsequent to the step of rolling a helical pattern of serrations thereinto.
Figure 3:
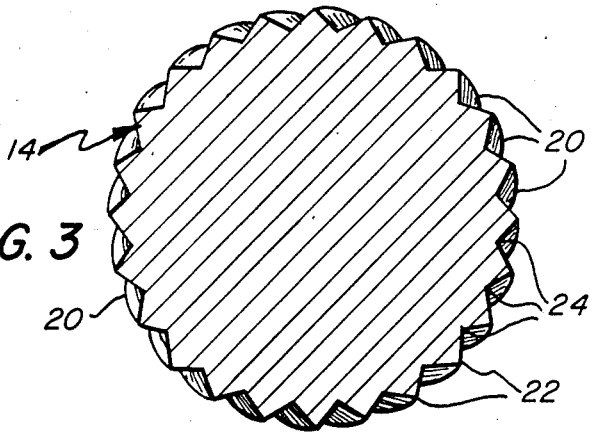
FIG. 3 is an enlarged cross sectional view along the line 3—3 of FIG. 12.

In FIGS. 2 and 3, there is illustrated a first form of abrading element embodying the present invention. The abrading element or metallic rod is generally designated by the numeral 14, and is elongated with skewed or angled, parallel end surfaces 16. The peripheral surface along the elongated axis has a helical pattern of serrations 20 formed therein which is seen in FIG. 3 to provide cutting edges 22 at the outer surfaces thereof, and recesses 24 therebetween.

Figure 4:
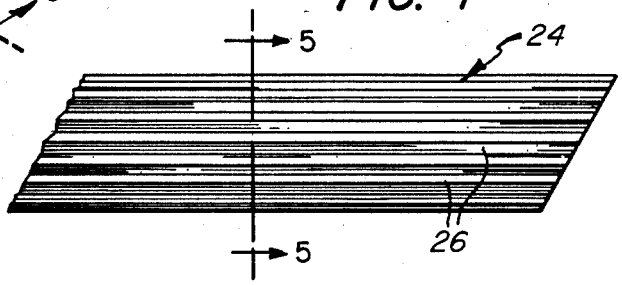
FIG. 4 is a side elevational view of another embodiment of abrading element embodying the present invention wherein the serrations extend longitudinally along the elongated axis of the abrading element.
Figure 5:
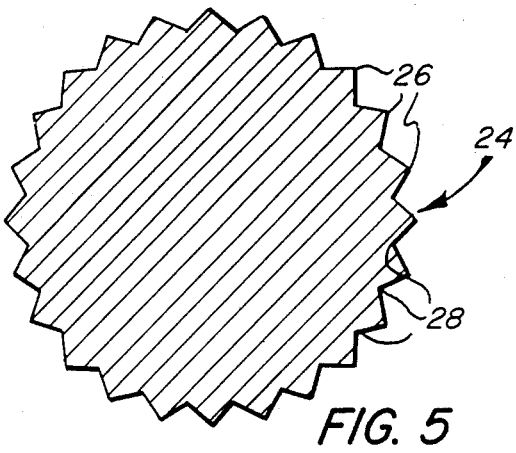
FIG. 5 is a cross sectional view along the line 5—5 of FIG. 4 and drawn to an enlarged scale.

Turning now to the embodiment of FIGS. 4 and 5, the abrading element 24 has the serrations extending axially or longitudinally along the length thereof so that the abrading, cutting edges 26 and recesses 28 extend axially thereof.

Figure 7:
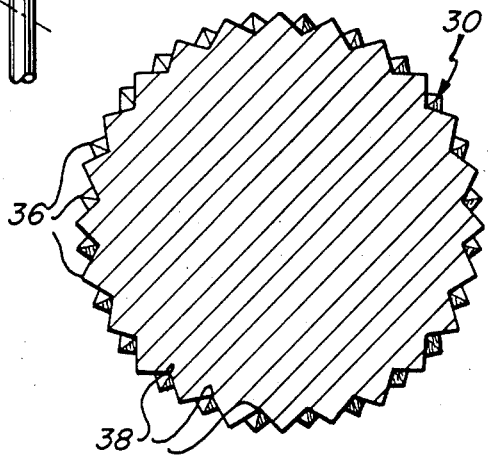
FIG. 7 is a cross sectional view to an enlarged scale along the line 7—7 of FIG. 6.
Figure 6:
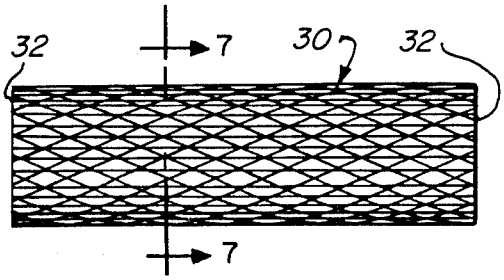
FIG. 6 is a view similar to FIG. 4 of an embodiment wherein the serrations are formed in a diamond pattern.

In the embodiment of FIGS. 6 and 7, the abrading element 32 has its end surfaces 32 in a plane perpendicular to the longitudinal axis and a diamond pattern of serrations extends over its periphery to provide intersecting abrading edges 36 and intersecting recesses or valleys 38 therebetween.

Although the abrading elements may be fabricated from other metals including zinc and refractory metals depending upon the hardness and other characteristics desired, steel has been found particularly advantageous because of its relatively low cost, its availability in rod and wire stock providing the desired diameter for the abrading elements, and the ease for effecting either surface or full hardening thereof by conventional hardening techniques. Wire and rod stock of low carbon steel is readily available at relatively low cost, and may be subjected to surface hardening by carburizing or nitriding processes to provide the desired hardness after the serrations have been formed in the annealed material.

The size of the abrading elements will vary with the finishing operation desired and the workpieces to be processed. Generally, they will be within the range of 0.25–2.5 inches in length and a diameter of 0.025–0.5 inch, preferably 0.5–1.5 inches and 0.125–0.280 inch respectively. Normally, the length to diameter ratio will be 2–7:1, and preferably at least 3.6:1.

As previously discussed, the serrations provide ribs with cutting edges along their outer edges. Accordingly, they are preferably of inverted V-shaped cross section. The height of the ribs may vary from 0.010–0.090 inch, and is preferably in the range of 0.025–0.050 inch. They should be so closely spaced as is possible without sacrificing the strength of the ribs formed by the serrations. Generally, this will require a spacing within the range of 10–40 threads per inch.

With the abrading elements of the present invention, an abrasive finishing compound is not required. There is little tendency for the media to degrade by the finishing operation to any significant extent, and they will not clog recesses in the workpieces. Thus, the finishing compounds may simply be those which keep the surface of the workpiece clean and aid in the removal of the material abraded from the workpiece.

As indicated in the illustrated embodiments, the ends of the elements may be skewed relative to a plane drawn perpendicular to the longitudinal axis, or perpendicular thereto. To some extent, the skewed ends facilitates movement of the abrading elements about the workpieces and into recesses formed therein. However, the configuration of the ends may also be rounded, pointed, conical, or of any other suitable shape. Although the cross section is most desirably circular, as shown in the illustrated embodiments, other curvilinear cross sections may also be employed.

When the end surfaces are planar, generally they will not have serrations thereon because it is the axial surface which performs the bulk of the abrading action. If they are conical, or otherwise axially extending, then serrations may desirably be provided thereon albeit with greater cost and difficulty.

The method for forming the abrading elements may vary. Generally, wire or rod stock will be employed as the starting material. The wire or rod stock is severed in the desired length, and the individual abrading elements are then subjected to a thread rolling, drawing, milling or other forming operation to provide the desired serrations along the periphery thereof. Conveniently, this is accomplished in a thread rolling apparatus which generates a helical configuration for the serrations as the elements pass through the die.

Alternatively, the rod or wire stock may be drawn through a die to produce axially extending serrations before the individual abrading elements are cut therefrom, or the abrading elements may be cut and then passed through such a die to produce the axial serrations. In another type of die, the thread rolling apparatus may generate a diamond pattern of serrations.

Generally, the forming steps will involve chopping the rod or the wire stock into the desired length, tumbling the chopped elements, subjecting them to the serration forming operation, and then hardening them. As will be readily apparent, recutting, tumbling and the serration forming steps are much more readily performed on material which is in an annealed condition.

As has been previously indicated, the hardening operation may be a case hardening operation (carburizing, nitriding, etc.) when low carbon steel is utilized, or it may be a full thermal hardening operation when a high carbon or alloy steel is employed.

Generally, the hardening should produce a hardness of at least 50 on the Rockwell "C" scale; and preferably 55–62. The elements should be hardened to a depth of at least 0.015 inch, and preferably at least 0.02 inch.

Illustrative of the efficacy of the present invention is the following specific example. Low carbon steel wire of 7/32 inch diameter was severed in lengths of $\frac{7}{8}$ inch, with the ends on a diagonal as indicated in FIGS. 1–4 of the drawing attached hereto. The chopped lengths were tumbled to remove burrs, and then they were fed by a vibratory feeding device to a thread rolling machine wherein a helical thread of 0.030 inch depth and a pitch of 33 per inch was rolled therein. The abrading elements were then heat treated in a carburizing atmosphere to produce a surface hardness of 58 on the Rockwell "C" scale, and a case hardened depth of 0.02 inch.

To evaluate the efficacy of the abrading elements, one cubic foot of aluminum stock in the form of 2"×2" angles was placed in a vibratory finishing machine, together with 900 pounds of the abrading elements. A commercially available alkaline cleaning compound of nonabrasive character was added to serve as a lubricant and rust inhibitor and to keep the media free cutting. It was used in a mixture of 2 ounces per gallon of water, and the solution was continually flowed through the apparatus.

Samples withdrawn from the vibratory finishing operation after five hours showed a material removal rate of 0.010 (inch thickness material removed per hour) and excellent radiusing of the workpieces.

After 237 hours, the material removal rate was found to be 0.009 and excellent radiusing was observed on the workpieces.

No clogging of the media was observed at any time. After 237 hours, no significant wear of the serrations was observed on the abrading elements.

Thus, it can be seen from the foregoing detailed specification and attached drawing that the abrading elements produced in accordance of the present invention enjoy long life and are excellent for abrading workpieces without the need for an abrasive finishing compound. They may be formed relatively readily and are relatively low cost and long-lived.

Having thus described the invention, what is claimed is:

1. An abrading element for mass finishing operations comprising an elongated wrought metallic rod of generally curvilinear and substantially uniform cross section along its length between its end faces, said rod being formed from stock with a diameter of 0.025–0.5 inch and a length of 0.25–2.5 inches, with an L/D ratio of at least 2:1, said rod having closely spaced serrations over substantially it entire periphery along its elongated axis to provide 10–40 serrations per inch, said serrations providing cutting edges along the outer surfaces thereof and recesses therebetween, the metal of said rod being hardened at least adjacent the surface thereof.

2. The abrading element in accordance with claim 1 wherein said rod has a generally circular cross section.

3. The abrading element in accordance with claim 1 wherein the axial ends of said rod are skewed relative to a line perpendicular to said elongated axis.

4. The abrading element in accordance with claim 1 wherein said serrations extend generally axially of said rod.

5. The abrading element in accordance with claim 1 wherein said serrations extend generally helically about the periphery of said rod.

6. The abrading element in accordance with claim 1 wherein said serrations are disposed in a diamond pattern.

7. The abrading element in accordance with claim 1 wherein the metal of said rod is low carbon steel and the surface of said rod is case hardened.

8. The abrading element in accordance with claim 1 wherein the metal of said rod is a relatively high carbon steel and said rod is hardened substantially throughout its cross section.

9. The abrading element in accordance with claim 1 wherein said serrations of rod are provided by rolling a helical thread thereinto.

10. The abrading element in accordance with claim 1 wherein the metal of said rod is low carbon steel and the surface of said rod is case hardened.

11. The abrading element in accordance with claim 10 wherein said rod has a surface hardness of at least 50 on the Rockwell "C" scale.

* * * * *